US010179270B2

(12) United States Patent
Larose

(10) Patent No.: US 10,179,270 B2
(45) Date of Patent: Jan. 15, 2019

(54) TARGET TRAINING APPARATUS AND METHODS INCLUDING GOAL ACCESS

(71) Applicant: Cory Larose, Maple Grove, MN (US)

(72) Inventor: Cory Larose, Maple Grove, MN (US)

( * ) Notice: Subject to any disclaimer, the term of this patent is extended or adjusted under 35 U.S.C. 154(b) by 0 days.

(21) Appl. No.: 15/375,155

(22) Filed: Dec. 11, 2016

(65) Prior Publication Data

US 2018/0161654 A1 Jun. 14, 2018

(51) Int. Cl.
*A63B 69/00* (2006.01)
*A63B 63/00* (2006.01)
*A63B 102/24* (2015.01)

(52) U.S. Cl.
CPC ..... *A63B 69/0026* (2013.01); *A63B 63/004* (2013.01); *A63B 2102/24* (2015.10); *A63B 2209/08* (2013.01); *A63B 2225/09* (2013.01)

(58) Field of Classification Search
CPC ..... A63B 69/0026; A63B 63/004; A63B 2102/24; A63B 2209/08; A63B 2225/09; A63B 63/00; A63B 69/00
USPC ..... 473/422, 446, 454–456, 478; 273/398–402; D21/705, 699
See application file for complete search history.

(56) References Cited

U.S. PATENT DOCUMENTS 2,873,969 A * 2/1959 Ziel ..... A63B 69/0002 473/456
4,173,337 A * 11/1979 Okonowski ..... A63B 69/0002 473/456
4,921,257 A * 5/1990 Heller ..... A63B 63/00 473/446
D309,486 S * 7/1990 Guenette ..... D21/699
4,948,147 A * 8/1990 Pallanca ..... A63B 63/00 473/478
5,664,784 A * 9/1997 Redlich ..... A63B 63/00 473/446
D413,949 S * 9/1999 Oudemool ..... D21/705
6,736,739 B1 * 5/2004 Epworth ..... A63B 63/004 473/443
7,037,219 B2 * 5/2006 Pakieser ..... A63B 69/002 473/422
8,246,494 B2 * 8/2012 Stephenson ..... A63B 63/004 473/422
9,427,645 B1 * 8/2016 Salscheider ..... A63B 69/0026 473/446
9,433,841 B2 * 9/2016 Siefker ..... A63B 63/004 473/446
9,724,580 B2 * 8/2017 Goldwitz ..... A63B 69/00 473/446

(Continued)

*Primary Examiner* — Mitra Aryanpour

(57) ABSTRACT

Described herein are illustrative embodiments of an ice hockey target training apparatus for training users to shoot pucks into a standard sized NHL goal, and methods for retrieving pucks from behind such apparatus. The apparatus may include a blocking surface including a first blocking portion and a second blocking portion coupled by a coupling mechanism. The first blocking portion may be configured to be coupled to a goal and to cover at least a portion of the upper portion of the goal. The second blocking portion configured to cover at least a portion of the lower portion of the goal. The coupling mechanism may be configured to move the second blocking portion relative to the first blocking portion to access the base of the goal to retrieve the scoring media from within the goal while the first blocking portion remains coupled to the goal.

15 Claims, 8 Drawing Sheets

(56) References Cited

U.S. PATENT DOCUMENTS

| | | | | |
|---|---|---|---|---|
| 2007/0265115 | A1* | 11/2007 | Farquhar | A63B 63/004 473/446 |
| 2008/0076606 | A1* | 3/2008 | Siefker | A63B 63/004 473/446 |
| 2009/0181810 | A1* | 7/2009 | Stephenson | A63B 63/004 473/446 |

* cited by examiner

TARGET TRAINING APPARATUS AND METHODS INCLUDING GOAL ACCESS

TECHNICAL FIELD

This disclosure relates generally to equipment for sports that include shooting objects (e.g., scoring media) into goals. The apparatus is used to train users to develop their shooting techniques in order to improve the users shooting accuracy. In particular, this disclosure is related to equipment for the sport of ice hockey.

BACKGROUND

Equipment for training athletes to improve their skill at shooting objects (e.g., scoring media) into a goal are known. For example, with respect to the sport of ice hockey, shooting targets are known and used to help train ice hockey players to develop their shooting techniques and accuracy. These shooting targets typically have openings or cutouts in different areas on the target.

The athlete trains by attempting to shoot the scoring media through the openings or cutouts. Although the conventional shooting targets may function for their intended purposes, they do have limitations. Attaching and detaching shooting targets to and from the goal in order to collect scoring media (e.g., pucks) that have passed into the goal is a time-consuming process. Alternatively, trying to "fish out" pucks from behind the target without removing the target frustrates users, and in some cases, pucks cannot be removed without detaching or at least partially detaching the target. This is particularly frustrating for young users and a time drain on coaches.

The present disclosure solves problems related to retrieving pucks from behind conventional shooting targets. In conventional shooting targets, the pucks are retrieved either by detaching the target from the goal, or by the user using the stick to try and "fish out" pucks from behind the goal through small openings. This wastes expensive ice time, and in the case of younger players, the coaches time as well. The apparatus and methods described herein improve the efficiency of practice time and help users retrieve pucks more easily. Even younger users can do this more independently without help from a coach.

For the purposes of brevity and clarity, this disclosure will be described with respect to the sport of ice hockey, but the apparatus and methods may be used in other sports having a goal or goal-type aspect, and to any standard-sized goal or non-standard sized goal.

SUMMARY

In general, this disclosure is directed to equipment for sports that include shooting objects (e.g., scoring media) into goals.

In one illustrative embodiment of an ice hockey target training apparatus for training users to shoot pucks into a standard sized national hockey league (NHL) goal, the apparatus may include a blocking surface having a first blocking portion configured to be coupled to a standard sized NHL goal and to cover at least a portion of the upper portion of the goal. The apparatus may also include a second blocking portion configured to cover at least a portion of the lower portion of the goal. The apparatus may also include a coupling mechanism. The coupling mechanism may be configured to pivotably or slidingly move the second blocking portion relative to the first blocking portion to allow the user to access the base of the goal to retrieve the pucks from within the goal. Retrieval may be accomplished while the first blocking portion remains coupled to the goal. The coupling mechanism between the first blocking portion and the second blocking portion is arranged to extend along a line across the opening of the goal from a left side of the goal to a right side of the goal.

One illustrative embodiment of an apparatus for training users to shoot an object into a goal may be described as including a blocking surface including a first blocking portion and a second blocking portion. The first blocking portion configured to be coupled to a goal and to cover at least a portion of the upper portion of the goal. The second blocking portion may be configured to cover at least a portion of the lower portion of the goal. The second blocking portion may be coupled to the first blocking portion by a coupling mechanism. The coupling mechanism may be configured to move the second blocking portion relative to the first blocking portion to allow the user to access the base of the goal to retrieve pucks from within the goal while the first blocking portion remains coupled to the goal. In some embodiments, the second blocking portion is pivotably or slidably coupled to the first blocking portion by the coupling mechanism.

One illustrative embodiment of a method of retrieving pucks from behind a target training apparatus may include first receiving the apparatus. The apparatus may include a blocking surface having a first blocking portion and a second blocking portion. The first blocking portion may be configured to be coupled to a goal and to cover at least a portion of the upper portion of the goal. The second blocking portion may be configured to cover at least a portion of the lower portion of the goal. The second blocking portion may be coupled to the first blocking portion such that the second blocking portion is movable relative the first blocking portion to allow the user to access the base of the goal to retrieve pucks from within the goal while the first blocking portion remains coupled to the goal.

Other steps of the illustrative method may further include coupling the apparatus to the goal, such as coupling the first blocking portion to the goal. The method may include shooting objects at the goal. Moving the second blocking portion relative to the first blocking portion to access the lower portion of the goal, and removing pucks from within the goal from the lower portion of the goal that was at least partially blocked by the second blocking portion prior to moving the second blocking portion relative to the first blocking portion. In some embodiments, the coupling step includes coupling the first blocking portion to an upper forward structure of the goal, such as at the upper front portion of the goal opening. In some embodiments, the moving step includes moving the second blocking surface relative to the first blocking portion by pivoting or sliding the second blocking portion with respect the first blocking portion while the first blocking portion remains coupled to and substantially stationary with the goal.

The details of one or more examples are set forth in the accompanying drawings and the description below. Other features, objects, and advantages will be apparent from the description and drawings, and from the claims.

DETAILED DESCRIPTION

Figure 1A:
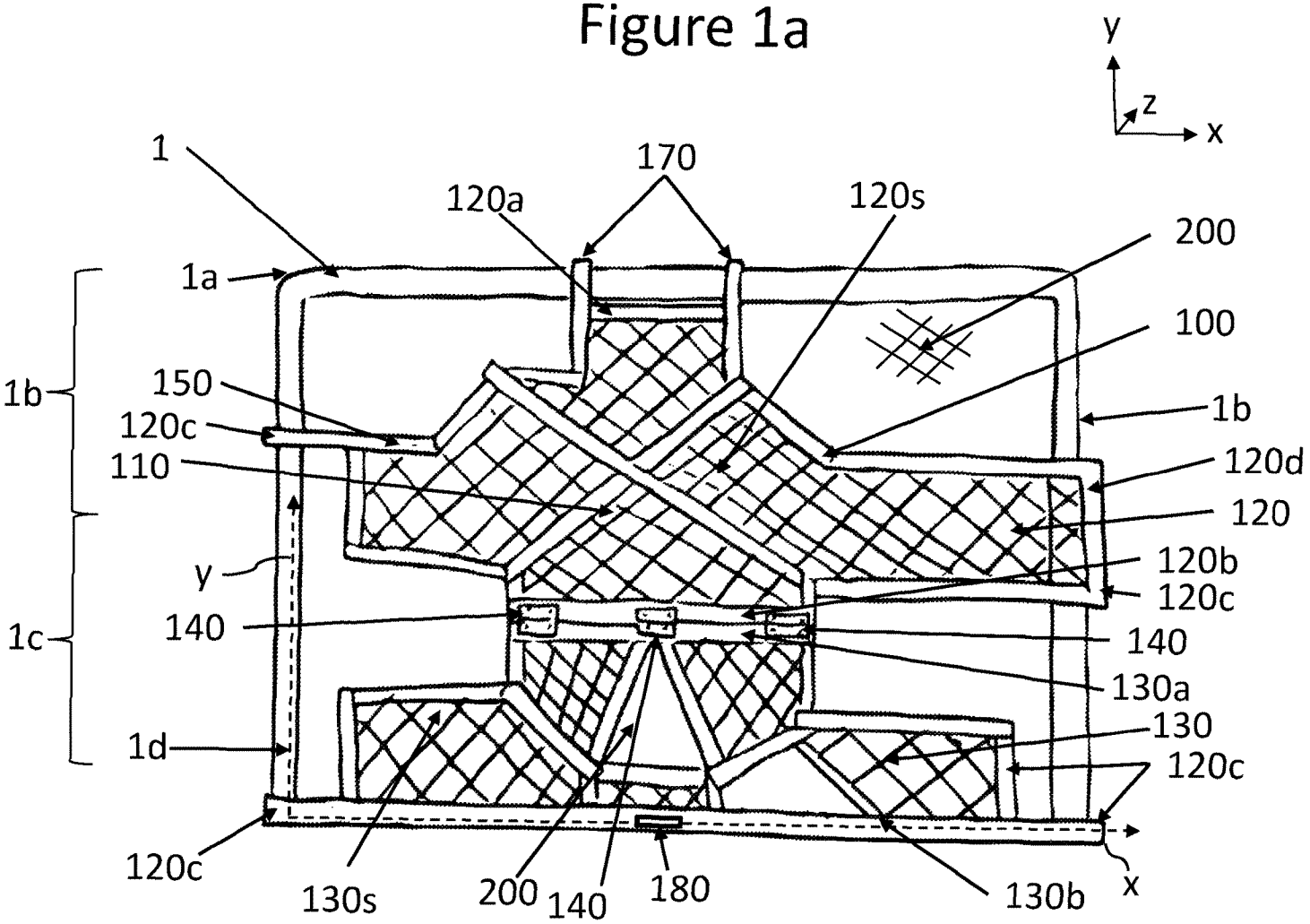
FIG. 1*a* is a front view of an ice hockey goal including an illustrative embodiment of a target training apparatus. The apparatus is shown attached to a goal and in a training position.
Figure 1B:
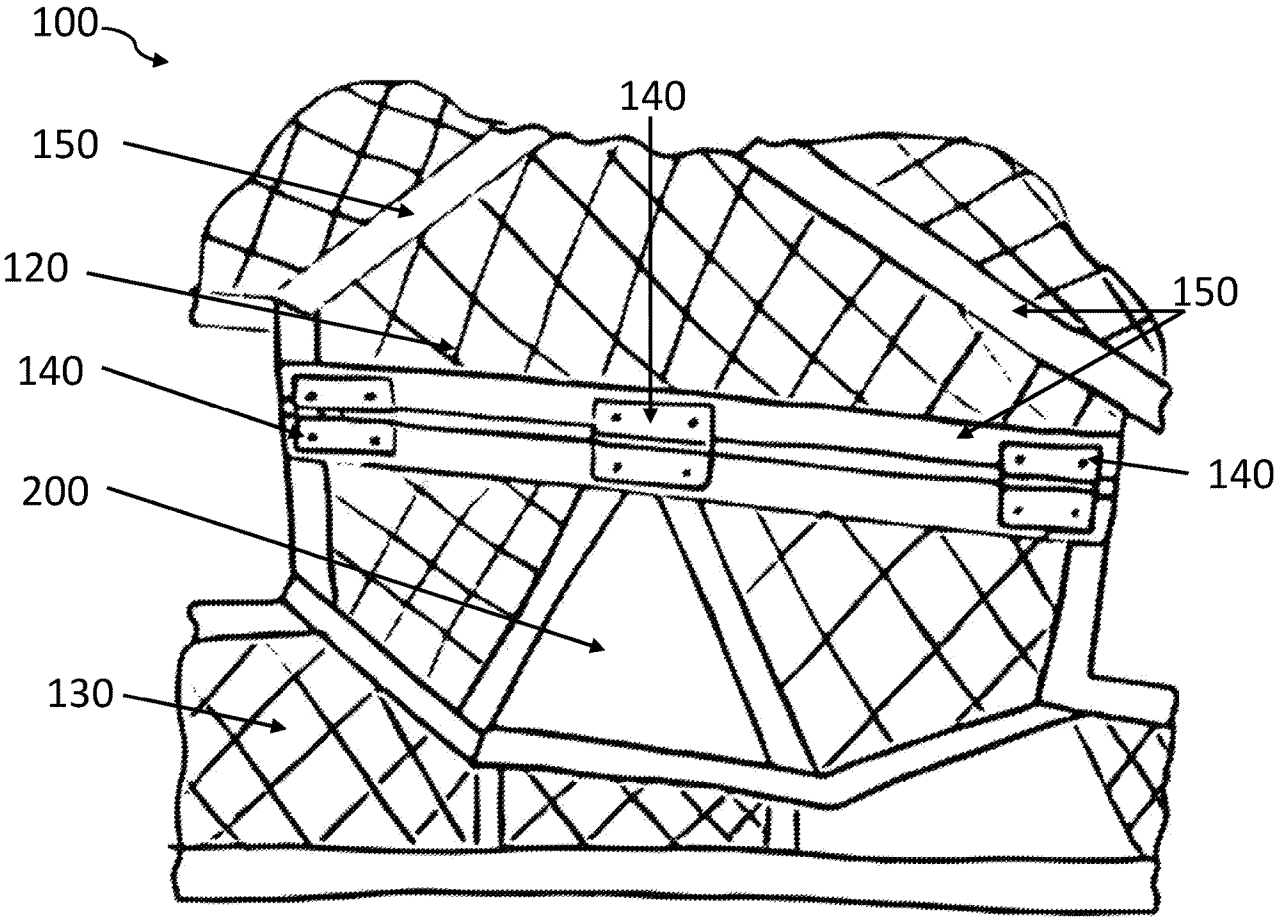
FIG. 1*b* is a close-up view of a portion of the target training apparatus of FIG. 1 in the training position.
Figure 1C:
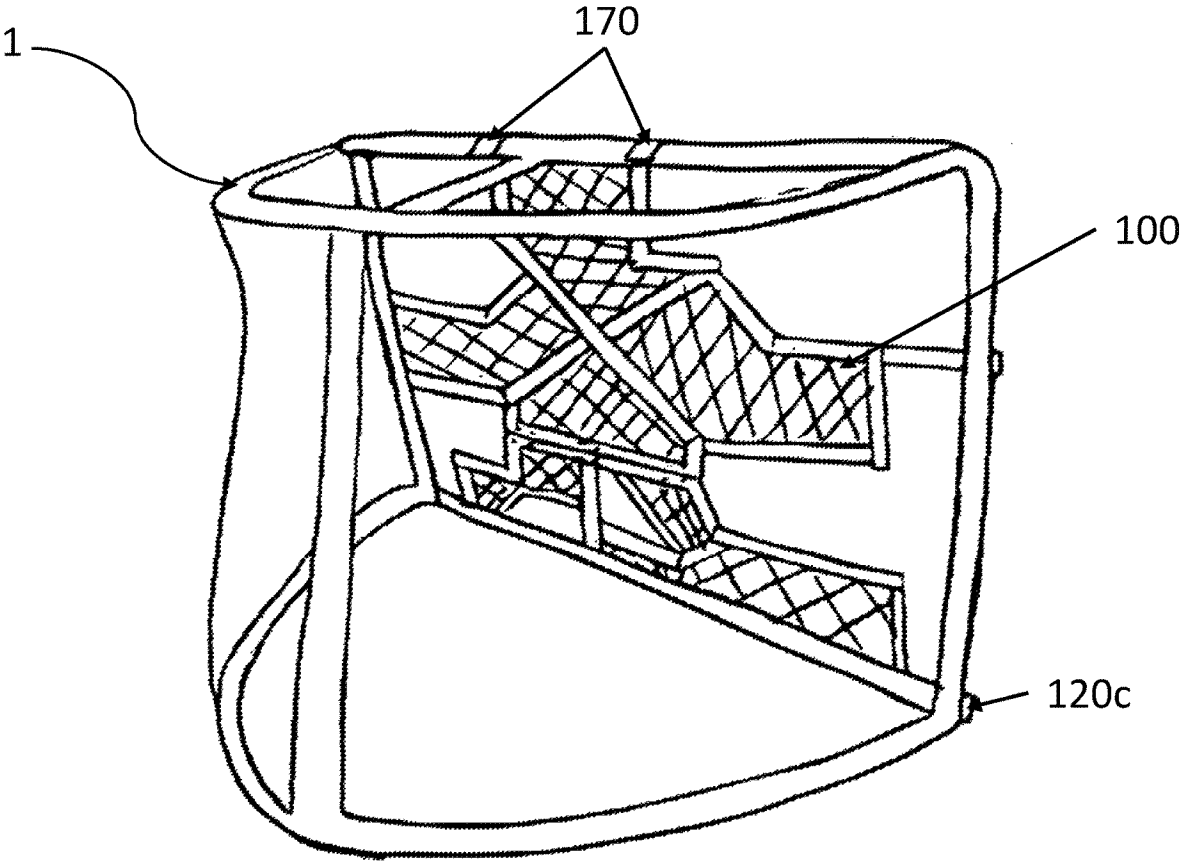
FIG. 1*c* is a rear perspective view of the target training apparatus of FIG. 1 attached to a goal in the training position.
Figure 1D:
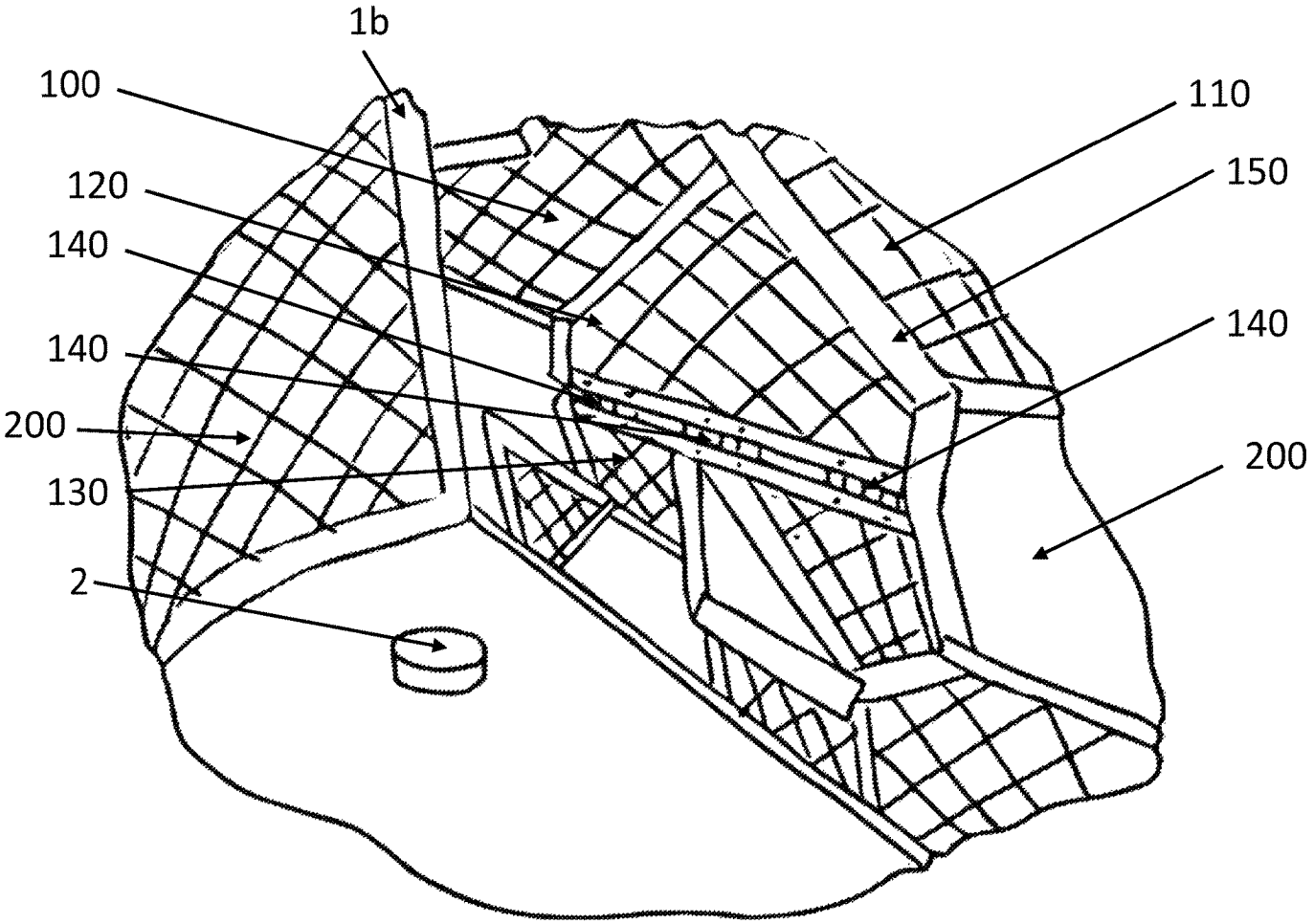
FIG. 1*d* is a rear perspective view of the target training apparatus of FIG. 1 attached to a goal in the training position. This view is taken from within the goal.

In the following detailed description of illustrative embodiments, reference is made to the accompanying figures of the drawings which form a part thereof, and in which are shown, by way of illustration, specific embodiments which may be practiced. It is to be understood that other embodiments may be utilized and structural changes may be made without departing from (e.g., still falling within) the scope of the disclosure presented hereby.

Illustrative embodiments shall be described with reference to FIGS. 1*a*-1*d* and 2*a*-2*c*. It will be apparent to one skilled in the art that elements (e.g., apparatus, structures, parts, portions, regions, configurations, functionalities, method steps, materials, etc.) from one embodiment may be used in combination with elements of the other embodiments, and that the possible embodiments of such apparatus, system and methods using combinations of features set forth herein is not limited to the specific embodiments shown in the figures and/or described herein. Further, it will be recognized that the embodiments described herein may include many elements that are necessarily shown to scale. Still further it will be recognized that the size and shape of various elements herein may be modified but still fall within the scope of the present disclosure, although certain one or more shapes and/or sizes or types of elements, may be advantageous over others. Any use of directional descriptions such as upwards and downwards, left, right is in relation to the system as one of ordinary skill in the art would commonly use when looking at the apparatus from the front and describing the apparatus in the upright position. For convenience, axes may be described in the drawings. The y-axis reflecting a vertical direction (e.g., along the height of the goal 1). The x-axis reflecting a horizontal direction (e.g., across the width of a goal). The z-direction reflection a horizontal direction (e.g., the depth into the goal perpendicular to the x-axis)

Illustrative apparatus and methods for training users to more accurately shoot an object into a goal for use in sports and games including goals and scoring media will be described herein. The disclosure will be described with respect to ice hockey, but may be used in other sports such as soccer and lacrosse or any other suitable sport or game. The scoring media may be described with respect to pucks, but any other scoring media may be used, including balls or disks. The scoring media may pass into the goal by any appropriate means, but will be described with respect to a puck being shot into a goal. Other ways of projecting scoring media into the goals such as by throwing or kicking may be used interchangeably with shooting.

Figure 2A:
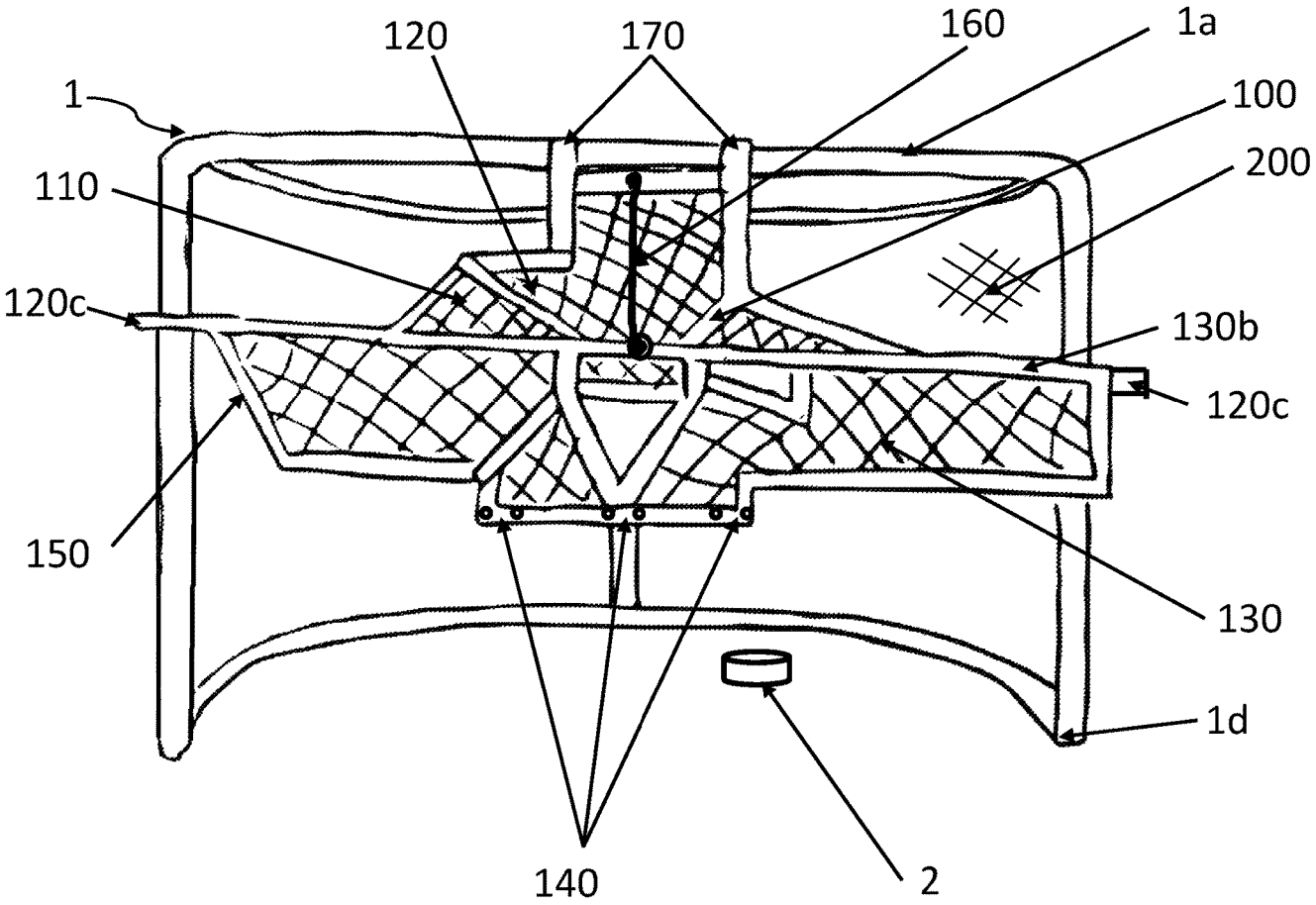
FIG. 2*a* is a front view of the target training apparatus of FIG. 1 attached to a goal and in a scoring media retrieval position.
Figure 2B:
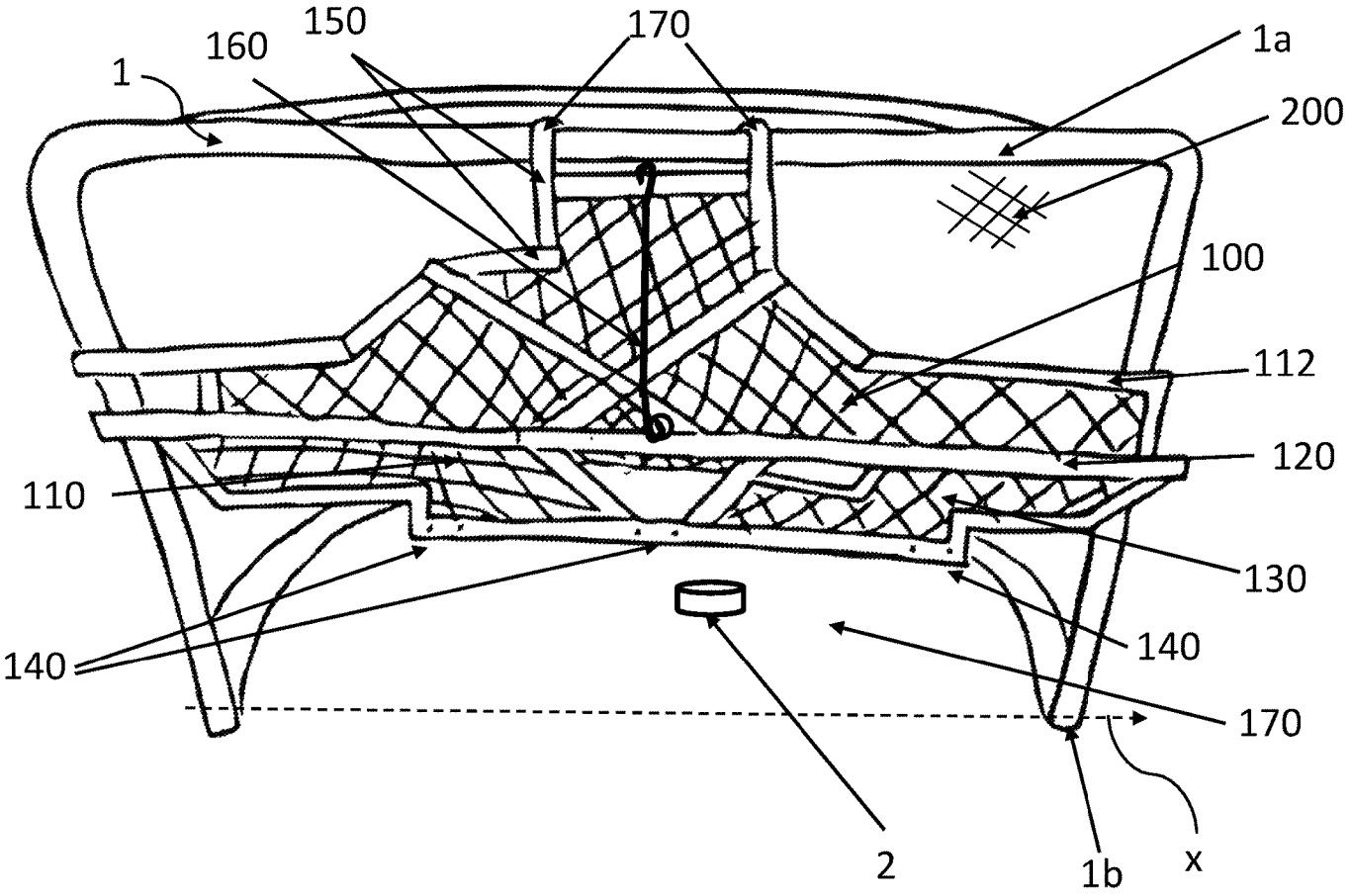
FIG. 2*b* is another front view of the target training apparatus of FIG. 1 attached to a goal in the scoring media retrieval position.
Figure 2C:
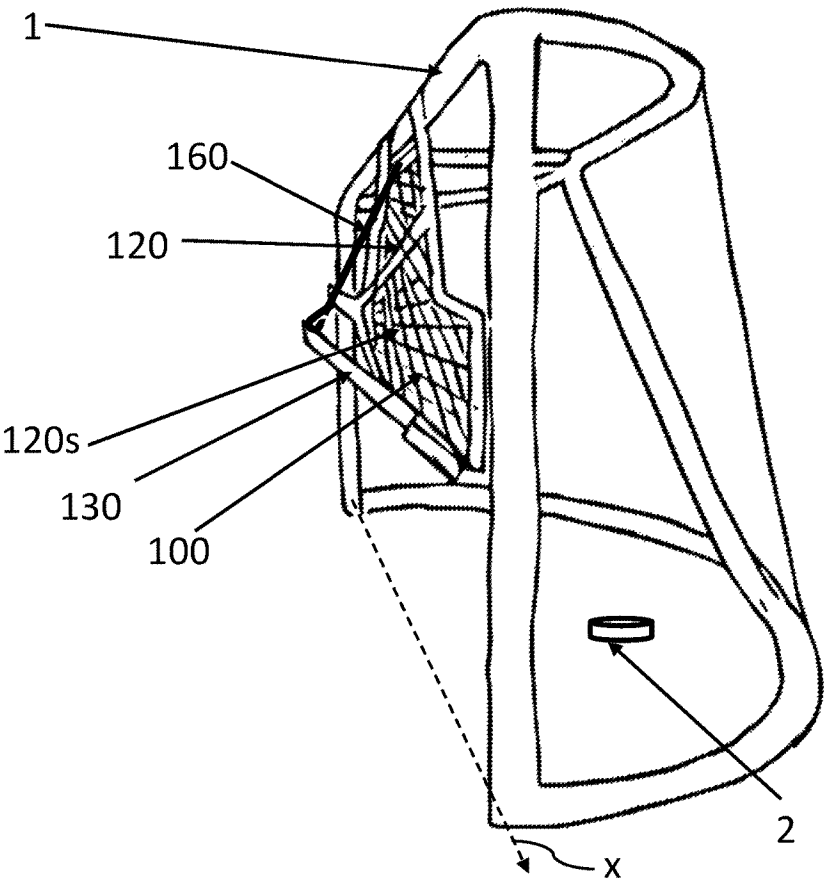
FIG. 2*c* is a side view of the target training apparatus of FIG. 1 attached to a goal in the scoring media retrieval position.

In the illustrative embodiment of FIGS. 1*a*-1*d* and 2*a*-2*c*, the target training apparatus 100 is shown attached to a goal 1. The apparatus 100 is shown in a training position (FIGS. 1*a*-1*d*), and in a scoring media retrieval position (FIGS. 2*a*-2*c*).

In FIGS. 1*a*-1*d*, the illustrative apparatus 100 is shown attached to the goal 1 in the training position. In the training position, the apparatus blocks a portion of the goal 1 in order to challenge users to shoot scoring media (e.g., objects, pucks) more accurately into the goal 1.

In order to retrieve scoring media 2 easily from behind the apparatus 100, the second blocking portion 130 may be moved from the training position to the retrieval position to allow users to easily access the area within the base of the goal 1 to retrieve the scoring media 2.

In FIGS. 2*a*-2*c*, the illustrative apparatus of FIGS. 1*a*-1*d* is show in a scoring media retrieval position (hereinafter, the retrieval position). In the retrieval position, access to the base of the goal 1 is less encumbered.

The base of the goal may be described as the entire area across the goal that is proximate or adjacent the ice. In some embodiments this may be described as the portion of the goal that is configured to be arranged directly adjacent the ice.

In the illustrative embodiment, the target training system 100 is shown attached to a standard-sized ice hockey goal 1. The dimensions of a standard-sized ice hockey goal are 72" wide×48" tall (6' wide×4' tall). This size is the standard dimension for regulation National Hockey League (NHL) goal and the goal that is provided in most rinks. In some embodiments, a smaller version for home/gym could be provided.

The target training apparatus 100 includes a blocking surface 110 having at least a first blocking portion 120 and a second blocking portion 130 coupled together by a coupling mechanism. The blocking surface 110 may be supported by a support frame 150 and attachment members 170. The illustrative embodiment may optionally include a securing device 160 and a handle 180.

The blocking surface 110 is configured to cover at least a portion of the goal 1 to make it more challenging for users to shoot scoring media 2 into the goal 1. The blocking surface 110 includes a first blocking portion 120 and a second blocking portion 130. The blocking surface 110 includes cutouts or openings 200 that allow access to a portions of the goal 1, while blocking other portions of the goal 1 when the apparatus 100 is attached to the goal 1. The blocking surface 110 may be configured such that scoring media 2 rebound and/or fall from the blocking surface 110 when scoring media 2 strike the blocking surface 110, but the scoring media 2 are allowed pass through the cutouts or openings 200 into the interior of the goal 1. The interior of the goal 1 being defined as the space within the enclosure of the goal 1 and behind a plane defining the opening (e.g., entrance to goal in xy plane) of the goal 1.

In the illustrative embodiment, the blocking surface 110 is made of netting and is supported by a support frame 150. In some embodiments, the blocking surface 110 and/or the support frame 150 may be made of any suitable material, including but not limited to plexiglass, one or more polymers, wood, metal, a composite of suitable materials or a polymer based composite fabric.

In the illustrative embodiment, the first or second blocking portions 120, 130 include respective first and second blocking surfaces 120*s*, 1302 supported by a structural frame 150. The structural frame serves to provide rigidity to one or both of the first or second blocking portions 120, 130, and may also provide attachment points (e.g., goal attachment members 170) for securing the apparatus 100 to the goal 1. It is contemplated that in other embodiments, the structural frame 150 may be omitted or incorporated directly or integrally with the surface(s) 110, 120*s*, 130*s*. For example, the function of the structural frame 150 could be integrally molded with any of the surfaces 110, 120*s*, 130*s*. Depending on the characteristics and durability the material used for the blocking surface 110, a structural frame 150 may be omitted.

In some embodiments, the blocking surface 110 and/or at least one of the first or second blocking portions 120, 130 is rigid such that first and second blocking portions 120, 130 are not foldable. As described herein, not foldable means not foldable like a piece of fabric or film material which would be foldable upon itself. Such as is the case with conventional a single piece tarp style target training apparatus. Tarp style target training apparatus are generally attached tautly to the goal 1 with straps or bungee cords. In the illustrative embodiment both the first and second blocking portions 120, 130 may be rigid such that the first blocking portion 120 is not foldable upon itself and/or the second blocking portion 130 is not foldable upon itself, except for any predetermined hinge points.

In the illustrative embodiment, the first and second blocking portions 120, 130 include one or more portions that extend beyond the opening of the goal 1 to react against the goal 1. Such as the left end portion 120*c* shown in FIG. 1*a*. In some embodiments, these extensions may not be present.

In the illustrative embodiment, the apparatus 100 is configured to be coupled to the goal 1. In some embodiments, the apparatus 100 may be configured to be attachable to a standard sized ice hockey goal. As shown in the illustrative embodiment, the first blocking portion 120 may be configured to be coupled to an upper end of the goal 1, such as by the goal attachment members 170 as shown in the FIGS. 1*a*, 1*c* and 2*a*-2*c*. Any suitable system or apparatus may be used to couple the apparatus to the goal 1. In the illustrative embodiment, the first blocking portion 120 further comprises one or more goal attachment members 170 in the form of one or more hooks configured to couple the apparatus 100 to the goal 1. The goal attachment member 170 may be provided in any suitable form.

The first blocking portion 120 covers at least a portion of the upper portion of the goal 1*b* (e.g., upper half above a midline across the goal). While the second blocking portion 130 may be configured to cover at least a portion of the lower portion of the goal 1*c* (e.g., lower half below a midline across the goal 1 that is halfway up the height of the goal 1).

In the illustrative embodiment, the height of the first blocking portion 120 is larger than the height of the second blocking portion 130. Specifically, the distance from the upper end portion 120*a* to the lower end portion 120*b* across the first blocking portion 120 is larger than the distance from the upper end portion 130*a* to the lower end portion 130*b* across the second blocking portion 130*b*, and the distance from the upper end portion 120*a* of the first blocking portion 120 to the lower end portion 130*b* of the second blocking portion 130 is substantially the same height as a standard sized ice hockey goal 1. In some embodiments, these relative heights could be flip flopped or equal to one another.

In some embodiments the first blocking portion 120 may cover 60 to 80% of the goal, while the second blocking portion 130 may cover the remaining 20 to 40% of the goal.

In the illustrative embodiment, the first blocking portion 120 may be coupled to the second blocking portion 130. In some embodiments, the coupling between the first and second blocking portions 120, 130 is facilitated by the coupling mechanism 140. The coupling mechanism(s) 140 may be configured to move the second blocking portion 130 relative to the first blocking portion 120 to allow the user to access the base of the goal 1*d* to retrieve the scoring media 2 from within the goal 1 while the first blocking portion 120 remains coupled to the goal 1.

There are a variety of coupling mechanism 140 that can be provided to couple the first and second blocking portions 120, 130 to one another. In the illustrative embodiment, the coupling mechanism 140 pivotably couples the first blocking portion 120 to the second blocking portion 130. For example, as shown in the figures, a hinge or hinges could extend laterally (from side to side) at least a portion of the way across the apparatus 100 (e.g., across the goal when the apparatus is attached to a goal). In other words, in the illustrative embodiment, the coupling mechanism 140 between the first blocking portion 120 and the second blocking portion 130 is located and configured to be arranged along a line parallel to a line extending across the opening of the base of the goal 1*d* from a left side of the goal to a right side of the goal (e.g., line x, axis x).

In some embodiments, the coupling mechanism 140 slidingly couples the first blocking portion 120 to the second blocking portion 130. For example, a pin in a track type of sliding mechanism could be provided on the right and left sides of the apparatus (and perpendicular to the hinges shown) instead of a hinge to provide generally linear motion of the second blocking portion relative to the first blocking portion.

In some embodiments, the coupling mechanism 140 could provide for the second blocking portion 130 to swing up towards the first blocking portion 120 not by a hinge, but by means of one or more 4-bar mechanism designs attached between the first and second blocking portions 120, 130, with the first and second blocking portions 120, 130 serving as two of the 4 elements in the 4-bar mechanism. A 4-bar design could be provided on both right and left sides of the apparatus 100 in order to provide even support to the second blocking portion 130 and aid in smooth movement and translation of the second blocking portion 130 upwards toward the first blocking portion 120.

In some embodiments, the second blocking portion 130 swings open laterally of the goal 1 along a vertical pivot axis (e.g., y-axis, or an axis parallel to the y axis, or substantially parallel such as within 15 degrees of they axis), thereby exposing the open base of the goal 1*d*. Any other suitable coupling mechanism 140 or method of providing relative motion between the first and second blocking portions 120, 130 may be used such that the base of the goal 1*d* is accessible in the retrieval position (FIGS. 2*a*-2*c*).

Aspects of the first and second blocking portions 120, 130 of the illustrative embodiment will now be described in further detail.

The first blocking portion 120 may extend along a first blocking plane in a vertical direction from an upper end portion 120*a* to a lower end portion 120*b*. The first blocking plane may be described as the xy plane in FIG. 1*a*. In the illustrative embodiment, the upper end portion of the first blocking portion 120*a* may be configured to be coupled to the goal 1. The first blocking portion 120 may also extend from side to side in the first blocking plane from a left end portion 120*c* to a right end portion 120*d*.

The second blocking portion 130 may extend along a second blocking plane from an upper end portion 130*a* to a lower end portion 130*b*. In the illustrative embodiment, the lower end portion of the first blocking portion 120*a* is pivotably or slidingly coupled to the upper end portion of the second blocking portion 130*a* by the coupling mechanism 140. The second blocking portion 130 may also extend from side to side in the second blocking plane from a right side to a left side. The second blocking plane may be plane xy as shown in FIG. 1*a*, or some plan substantially similar to the xy plane when the second blocking portion is in the training position. For example, a plane within ±15 degrees of plane xy, or in a more preferred embodiment, within ±10 degrees of the xy plane. In the retrieval position, the second blocking plane moves (e.g., the second blocking portion 120) moves out of the xy plane, especially in embodiments that include a pivoting relative motion. In some embodiments, the second blocking portion has a range of motion of at least 90 degrees between the training position and the retrieval position. In a more preferred embodiment, the second blocking portion has a maximum range of motion between 90 to 180 degrees between the training position and the retrieval position. In a most preferred embodiment, the second blocking portion has a maximum range of motion between 120 to 180 degrees between the training position and the retrieval position.

In the illustrative embodiments, the second blocking portion 130 provides a functional blocking surface without necessarily being coupled to the lower portion of the goal 1*c*.

For ergonomic reasons, a handle 180 may be coupled to the second blocking portion 130 at any suitable location on the second blocking portion 130 in order to allow the user to easily grasp and move the second blocking portion 130 relative to the first blocking portion 120. In the illustrative embodiment, no separate auxiliary handle is provided. In some embodiments, rather than providing a handle like a cabinet drawer pull, the placement of the central opening 200 in the second blocking portion serves the function of a handle 180 that can be grasped to lift up the second blocking portion 130.

In order to hold the second blocking portion 130 in the retrieval position (FIGS. 2*a*-2*c*), and to free up the user's hands to retrieve the scoring media 2 without the help of another user, the apparatus 100 may include a securing device 160. The securing device 160 may be configured to secure the second blocking portion 130 to the first blocking portion 120 in a releasable manner. In the retrieval position, access to the base of the goal 1*d* may be maintained in order to retrieve the scoring media 2 from within the goal 1 more easily. In some embodiments, and as shown in the illustrative embodiment, when the second blocking portion 130 is moved relative to the first blocking portion 120 to access the base of the goal 1*d*, the apparatus 100 enables unhindered removal of the scoring media 2 from within the goal 1 while the apparatus 100 remains coupled to the goal 1. In the illustrative embodiment access is achieved while the first blocking portion 120 remains coupled to the apparatus 100 (e.g., substantially fixedly coupled). Substantially here means fixedly coupled, but with a normal amount of shifting due to the tolerance of the one or more goal attachment members 170 to the goal 1. Such as ±10%.

The securing device 160 may be provided in a variety of different forms. In the illustrative embodiment, the securing device 160 includes a strap having hooks at each end that are coupled to holes in each of the first and second blocking portions (FIG. 2*a*-2*c*). For example, the holes here are in the support frame 150. In some embodiments, the securing device 160 may be a hook attached to one of the first and second blocking portions 120, 130 and a looped strap coupled to the other of the first and second blocking portions 120, 130. In some embodiments, the securing device 160 includes a magnetic attachment system. In some embodiments, the securing device 160 includes a mechanical or electrical latching system. Any suitable securing device 160 may be provided.

An illustrative method 300 of retrieving scoring media 2 from behind a target training apparatus 100 that is blocking a goal 1 will now be described with reference to the previously described target training apparatus 100. Although the method 300 will be described specifically with respect to the apparatus 100, the method 300 could be applied to another embodiment of the apparatus.

Figure 3:
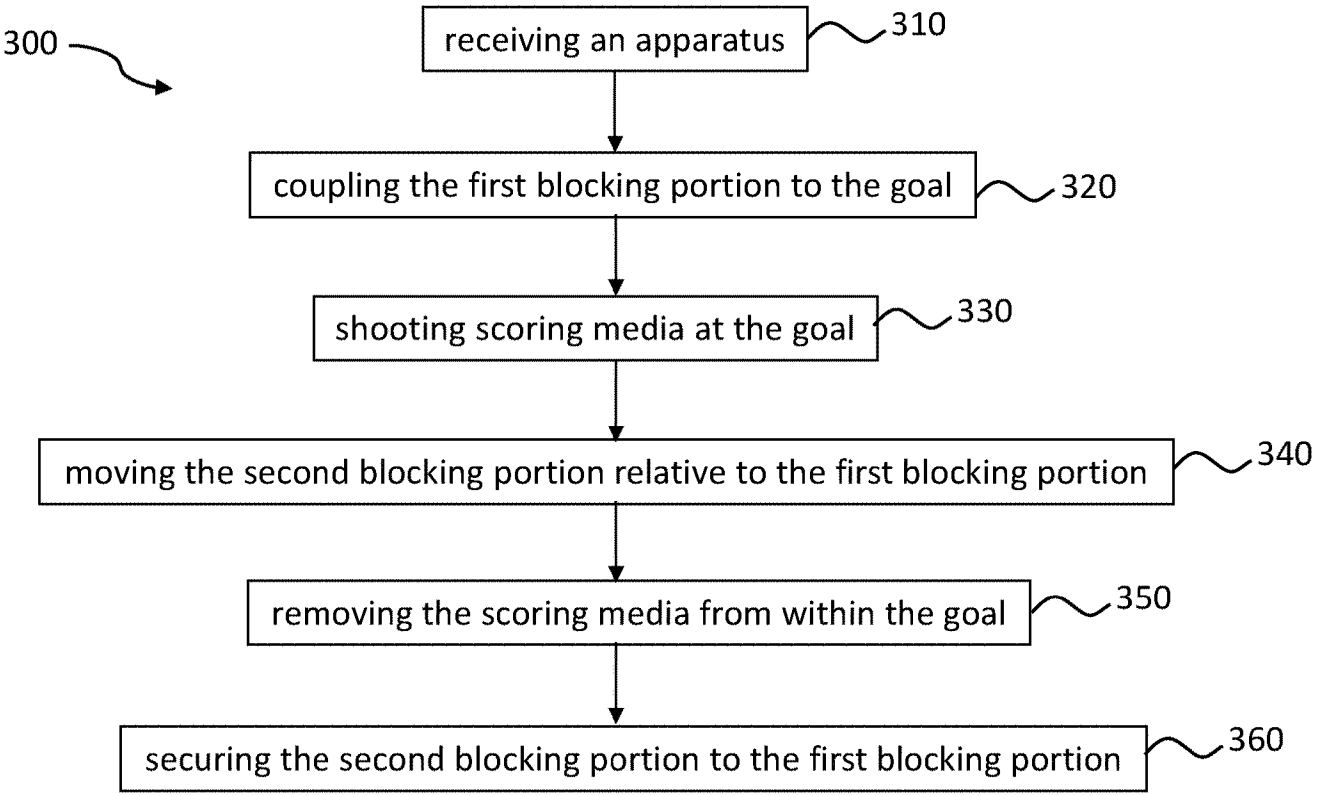
FIG. 3 is an illustrative embodiment of a method of using the target training apparatus.

As shown in FIG. 3, step 310 of the illustrative embodiment of the method 300 may include receiving the target training apparatus as described above.

Step 320 may include coupling the first blocking portion to an upper forward structure of the goal. In some embodiments, the goal that the apparatus is coupled to in step 320 is a standard sized ice hockey goal.

Step 330 may include shooting scoring media (e.g., objects) at the goal.

Step 340 may include moving the second blocking portion relative to the first blocking portion to access the lower portion of the goal. In some embodiments, step 340 of moving the second blocking surface relative to the first blocking portion is accomplished by pivoting or sliding the second blocking portion with respect the first blocking portion while the first blocking portion remains coupled to and substantially stationary with the goal.

Step 350 may include removing the scoring media from within the goal from the lower portion of the goal that was at least partially blocked by the second blocking portion prior to moving the second blocking portion relative to the first blocking portion.

In some embodiments, step 360 may include removably securing the second blocking portion to the first blocking portion to maintain open access to the lower portion of the goal. In the illustrative embodiment step 360 includes lifting the second blocking portion by a rope which serves as both a handle and a securing device and hooking it onto a hook-like feature of the first blocking portion.

Various examples have been described. These and other examples are within the scope of the following claims.

GENERAL ELEMENT LIST—NON-LIMITING EMBODIMENT

The following parts list is provided only for convenient reference and does not form a part of the claims. It is merely provided to enable easy review of a non-limiting embodiment of the claims.

Goal 1
Upper end of the goal 1*a*
Upper portion of the goal 1*b*
Lower portion of the goal 1*c*
Base of goal 1*d*
Scoring media 2
Blocking surface 110
First blocking portion 120
First blocking plane
First blocking surface 120*s*
First blocking portion upper end portion 120*a*
First blocking portion lower end portion 120*b*
First blocking portion left end portion 120*c*

First blocking portion right end portion 120*d*
Second blocking portion 130
Second blocking plane
Second blocking surface 130*s*
Second blocking portion upper end portion 120*a*
Second blocking portion lower end portion 120*b*
Second blocking portion left end portion 120*c*
Second blocking portion right end portion 120*d*
Structural frame 150
Line extending across the goal x
Coupling mechanism 140
Securing device 160
One or more goal attachment members 170
Cut outs or openings 200

What is claimed is:

1. A hockey training apparatus comprising:

an upper blocking portion pivotably connected to a lower blocking portion forming a blocking surface, the blocking surface comprising a structural frame, the blocking surface configured to deflect pucks;

a goal attachment member coupled to the structural frame, the goal attachment member configured to attach the structural frame to a hockey goal, wherein when the upper blocking portion is coupled to the hockey goal, the upper blocking portion covers at least a portion of the upper portion of the hockey goal, and wherein the lower blocking portion is configured to cover at least a portion of the lower portion of the hockey goal, and wherein the lower blocking portion includes an extension portion that prevents the lower blocking portion from being pivoted into the hockey goal when attached to the hockey goal, but does not prevent the lower blocking portion from being pivoted away from the hockey goal; and a coupling mechanism coupled to the upper blocking portion and the lower blocking portion, the coupling mechanism configured to provide the pivotable connection between the upper and lower blocking portions, wherein the coupling mechanism is configured to allow the lower blocking portion to pivot relative to the upper blocking portion to allow the user to access the base of the goal to retrieve the pucks from within the hockey goal while the first blocking portion remains coupled to the hockey goal.

2. The apparatus of claim 1, wherein the distance from an upper end portion to a lower end portion across the upper blocking portion is larger than the distance from an upper end portion to a lower end portion across the lower blocking portion.

3. The apparatus of claim 1, wherein the upper blocking portion extends along an upper blocking plane from an upper end portion to a lower end portion, wherein the upper end portion of the upper blocking portion is configured to be coupled to a goal by the goal attachment member, and wherein the lower blocking portion extends along a lower blocking plane from a upper end portion to a lower end portion, wherein the lower end portion of the upper blocking portion is pivotably coupled to the upper end portion of the lower blocking portion by the coupling mechanism.

4. The apparatus of claim 1, wherein blocking portion comprises a rigid element, and the lower blocking portion is not foldable or rollable upon itself.

5. The apparatus of claim 1, wherein the lower blocking portion comprises a rigid element that maintains a shape of the lower blocking portion without being attached to a goal.

6. The apparatus of claim 1, wherein the goal attachment member comprises a hook configured to hang and support the apparatus from an upper end of a goal.

7. The apparatus of claim 1, further comprising a handle coupled to a lower end portion of the lower blocking portion.

8. The apparatus of claim 1, further comprising a releasable securing device configured to secure the lower blocking portion to the upper blocking portion, and wherein the releasable securing device is configured to hold the lower blocking portion in a position that provides a user physical and visual access to the base of the goal to retrieve pucks from the base of the goal.

9. The apparatus of claim 1, wherein the entire base of the goal is accessible when the lower blocking portion is pivoted relative to the upper blocking portion, while the upper blocking portion remains coupled to the goal.

10. A hockey training apparatus comprising:

an upper blocking pivotably connected to a lower blocking portion forming a blocking surface configured to deflect pucks, and to at least partially define one or more target regions, wherein the target regions are formed as cutouts along the perimeter or openings in the blocking surface;

a coupling mechanism coupled to the upper blocking portion and the lower blocking portion, the coupling mechanism configured to provide the pivotable connection between the upper and lower blocking portions, wherein the coupling mechanism is configured to allow the lower blocking portion to pivot relative to the upper blocking portion to allow the user to access the base of the goal to retrieve the pucks from within the hockey goal while the first blocking portion remains coupled to the hockey goal; and a goal attachment member configured to attach the upper blocking portion to a hockey goal, wherein when the upper blocking portion is coupled to the hockey goal, the upper blocking portion covers at least a portion of the upper portion of the hockey goal, wherein the lower blocking portion is configured to cover at least a portion of the lower portion of the hockey goal, and wherein the lower blocking portion includes an extension portion that prevents the lower blocking portion from being pivoted into the hockey goal when attached to the hockey goal, but does not prevent the lower blocking portion from being pivoted away from the hockey goal.

11. The apparatus of claim 10, wherein the blocking surface further comprises a structural frame.

12. The hockey training apparatus of claim 10, wherein the upper blocking portion is rigid, and wherein the lower blocking portion is rigid.

13. The hockey training apparatus of claim 10, wherein the lower blocking portion is rigid such that the lower blocking portion is not foldable upon itself.

14. The hockey training apparatus of claim 10, wherein the coupling mechanism includes a hinge.

15. The apparatus of claim 1, wherein the coupling mechanism comprises a hinge.

* * * * *